United States Patent [19]

Marer

[11] 4,286,521

[45] Sep. 1, 1981

[54] DEVICE ACTUATED ELECTRICALLY TO TRIGGER A MECHANICAL PERCUSSION DETONATOR

[75] Inventor: Joseph Marer, Lyss, Switzerland

[73] Assignee: Redon Trust, Schaan, Liechtenstein

[21] Appl. No.: 60,334

[22] Filed: Jul. 25, 1979

[30] Foreign Application Priority Data

Jul. 27, 1978 [CH] Switzerland ..... 8070/78

[51] Int. Cl.[3] ..... F42C 19/06

[52] U.S. Cl. ..... 102/200; 102/204; 102/254; 102/275

[58] Field of Search ..... 102/28 R, 203, 204, 102/49.4

[56] References Cited

U.S. PATENT DOCUMENTS

| | | | |
|---|---|---|---|
| 2,575,071 | 11/1951 | Rockwell | 102/28 X |
| 2,681,701 | 6/1954 | Schlumberger | 102/203 X |
| 2,931,299 | 4/1960 | Sokolowski | 102/203 X |
| 3,110,846 | 12/1963 | Wedwick | 102/28 R |
| 3,306,202 | 2/1967 | Menichelli et al. | 102/28 R |
| 4,099,465 | 7/1978 | Haake | 102/204 |
| 4,195,550 | 4/1980 | Witt | 102/204 X |

*Primary Examiner*—Peter A. Nelson
*Attorney, Agent, or Firm*—Saul Jecies

[57] ABSTRACT

A device actuated electrically for triggering a mechanical percussion detonator, comprising a tubular container wherein is housed a striker with a percussion pin, an explosive cap actuated electrically and held secure by a cover and a detonator holder containing a mechanical percussion detonator that can be installed or moved afterwards opposite the striker in order to avoid any untimely explosion of the detonator.

3 Claims, 5 Drawing Figures

DEVICE ACTUATED ELECTRICALLY TO TRIGGER A MECHANICAL PERCUSSION DETONATOR

The object of this invention is an electrically actuated device for triggering a mechanical percussion detonator.

It is a known fact that electric detonators are dangerous as in accordance with manufacturing and application requirements they have but one single body that contains the electric cap and the detonator itself. These detonators are sensitive to electrostatic overvoltages, to stray currents, to atmospheric overvoltages, etc., and all those who handle such detonators know about the numberless causes that may bring about their untimely explosion.

The object of this invention is to limit the risks due to outside factors by separating the cap actuated electrically and the detonator itself and thus prevent its explosion during such handling.

The appended drawing shows, as an example, two embodiments of the device object of the invention.

Figure 1:
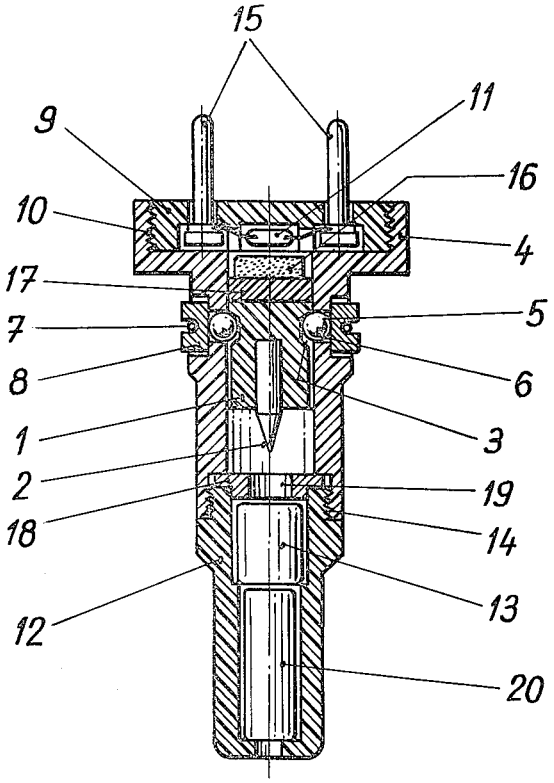
Figure 2:
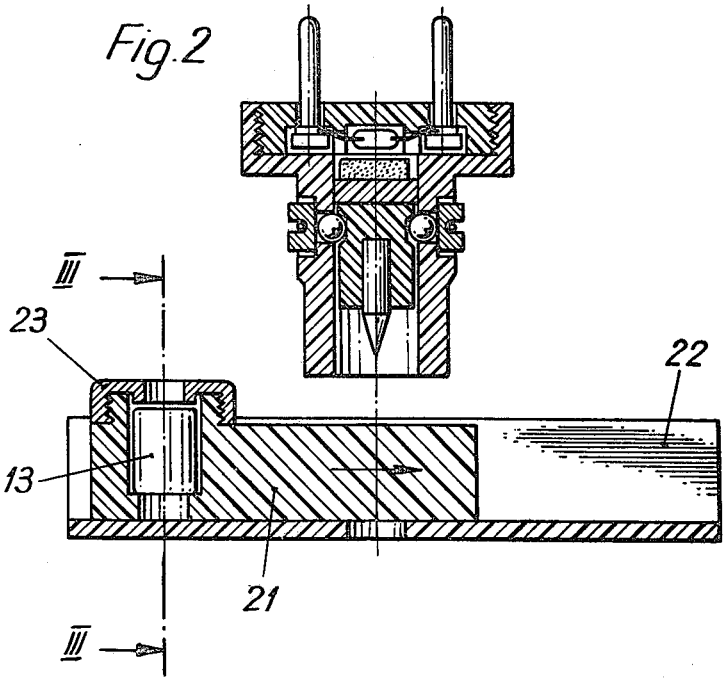
Figure 3:
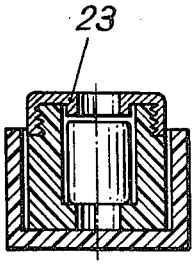
Figure 4:
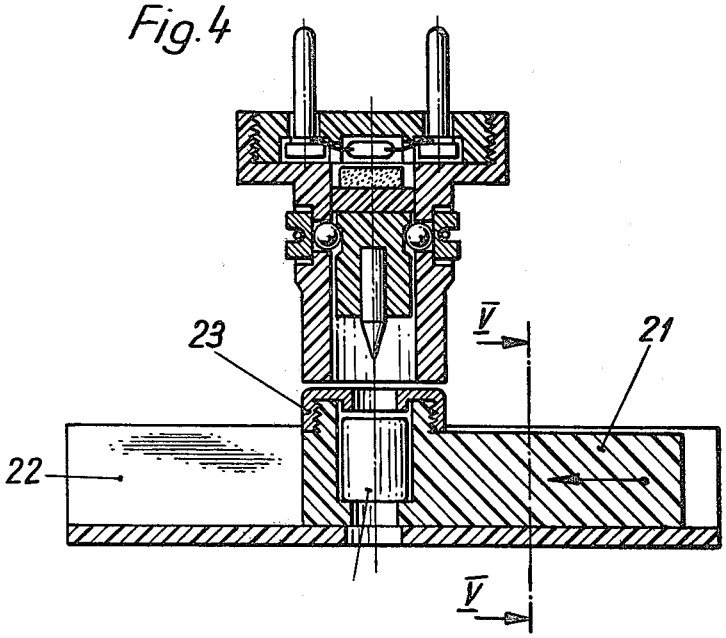
Figure 5:
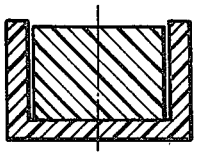

FIG. 1 is a vertical section of the device with a removable detonator holder, FIG. 2 is a vertical section of a device fitted with a detonator holder that can be shifted to move the detonator underneath the striker pin, and meant for a war mine, FIG. 3 is a sectional view according to line III—III of FIG. 2, FIG. 4 is a sectional view of FIG. 2 with the detonator noved underneath the striker pin, and FIG. 5 is a sectional view according to line V—V of FIG. 4.

The device shown has a cylinder-shaped striker 1, preferably made of plastic material and fitted with a steel percussion pin 2 and it displays, in its peripheral wall, an annular groove 3. A tubular container 4 made preferably of plastic material houses the striker 1 that can slide therein and that displays two diametrically opposed housings 5 wherein are found steel balls 6 that are thrust into the annular groove 3 by an elastic steel or plastic material ring 7 with an inserted ring 8 made of plastic material. A cover 9 screwed in 10 into the container 4 is provided with a recess wherein is installed an explosive cap 11 actuated electrically.

A detonator holder 12 that contains a mechanical percussion detonator 13 is connected to the container 4 by a threaded section 14 screwed into a tapped section in the wall of said container. Plugs 15 allow for the electrical connection.

Preferably, an explosive reinforcement 16 and a gasket 17 are installed under the explosive cap 11 in order to increase the percussion force of the striker 1, 2. A spacing washer 18 with a center hole 19 ensures the appropriate position of the detonator 13 and of its explosive reinforcement 20.

The device described above will function as below: at rest, the striker 1 will be held in safety position by the two balls 6 that act in the annular groove 3 under the effect of the elastic ring 7. If the cap 11 explodes under the effect of electric energy, the gasses bring their action to bear on the striker 1 that will then overcome the resistance of the balls 6 and forced downwards where its percussion pin 2 strikes the detonator 13 and makes it explode.

The design described here is very safe as for operations such as shipping, handling, establishing electric connections, etc., the detonator holder 12 containing the detonator 13 is removed. In other words, any untimely explosion of the electric cap causes only the striker 1, 2 to move. It cannot cause the detonator 13 to explode as this latter is out of reach for the percussion pin 2.

In the case of a war mine actuated electrically, preference is awarded to the design shown by FIGS. 2 to 5 where the shifting of the detonator 13 to face pin 2 of the striker 1 is effected either by hand or by an automated system and only when the mine is made operational. So as not to overburden the drawings, the references signs of the top section of the device—that are the same as those of FIG. 1—have not been repeated.

In these figures, the detonator 13 is housed in a case 21 that can shift in a support 22 orthogonally as compared to the motion of the striker 1, 2. A cover 23 secures the detonator 13 in case 21. In its inactive position (FIGS. 2 and 3) the detonator 13 is offset as compared to pin 2 of the striker 1 and it is obvious that if an untimely explosion of the electric cap 11 should occur, the pin 2 of the striker 1 will not act upon the detonator 13. Only when case 21 is in the position shown by FIGS. 4 and 5 can the detonator 13 be struck by the pin 2 of the striker 1 and explode.

I claim:

1. An igniting device for percussion detonators, comprising a tubular container;

a percussion striker device located in said container carrying;

a striker pin on one end thereof;

a detent device for detaining said striker device within said container;

an explosive cap located at the other end of said striker device;

a detonator housing;

at least one detonator charge movably mounted in said housing for movement between an operative position in the path of said striker and an inoperative position out of the path of said striker; and actuating means for applying pressure to said other end of said striker device for igniting that detonator.

2. An igniting device as claimed in claim 1 wherein said actuating means include electric impulses.

3. An igniting device for percussion detonators, comprising a tubular container;

a percussion striker device located in said container;

a striker pin carried by said percussion striker device at one end thereof;

an explosive cap located at the other end of said striker device;

a detonator housing detachably secured to said container;

at least one detonator charge located in said detonator housing;

actuating means including electrical impulse generating means to actuate said explosive cap to obtain movement of the striker device towards said detonator charge.

* * * * *